US006983688B1

(12) United States Patent
Papa et al.

(10) Patent No.: US 6,983,688 B1
(45) Date of Patent: Jan. 10, 2006

(54) DECORATION FOR BAGS AND CASES AND METHOD FOR APPLYING THE SAME

(75) Inventors: Frank J. Papa, Chester, NH (US); Agnes Csilla Domotor, Jamaica Plain, MA (US); Joshua B. Lederer, Brookline, MA (US); Maryann Ivers, Amesbury, MA (US)

(73) Assignee: The Gem Group, Inc., Lawrence, MA (US)

( * ) Notice: Subject to any disclaimer, the term of this patent is extended or adjusted under 35 U.S.C. 154(b) by 0 days.

(21) Appl. No.: 10/650,103

(22) Filed: Aug. 26, 2003

(51) Int. Cl.
*B41F 17/00* (2006.01)
*B41F 16/00* (2006.01)

(52) U.S. Cl. ..... 101/41; 101/163; 101/170; 101/492

(58) Field of Classification Search ..... 101/150, 101/163, 167, 169, 170, 41, 35, 492, 407.1, 101/474, 493; 269/287, 289 R, 309
See application file for complete search history.

(56) References Cited

U.S. PATENT DOCUMENTS

| | | | | |
|---|---|---|---|---|
| D96,506 | S | 8/1935 | Redman | |
| D177,266 | S | 3/1956 | Levitan | |
| D242,183 | S | 11/1976 | Davis | |
| D247,065 | S | 1/1978 | Koffler | |
| D254,157 | S | 2/1980 | Pelavin | |
| D285,868 | S | 9/1986 | Davis et al. | |
| 4,803,922 | A * | 2/1989 | Dennesen | 101/41 |
| D308,135 | S | 5/1990 | Kim | |
| 5,151,386 | A * | 9/1992 | Bottari et al. | 438/98 |
| 5,266,142 | A * | 11/1993 | Penrice | 156/240 |
| 5,403,025 | A * | 4/1995 | Shanley | 283/81 |
| 5,806,419 | A * | 9/1998 | Adner et al. | 101/35 |
| D405,957 | S | 2/1999 | Test | |
| D445,252 | S | 7/2001 | Klamm | |
| D458,749 | S | 6/2002 | Bruni et al. | |

OTHER PUBLICATIONS

U.S. App. No.: 29/182,660, filed May 29, 2003, by Domotor et al., for Decoration for Bags and Cases, all pages.

* cited by examiner

*Primary Examiner*—Leslie J. Evanisko
(74) *Attorney, Agent, or Firm*—Cesari and McKenna, LLP; William A. Loginov

(57) ABSTRACT

A custom decoration for bags, cases, portfolios and other business accessories (the "item") that can be printed at an appropriate location directly on the otherwise-finished item is provided. The decoration comprises a single or multi-colored ink image transferred from a lithographic plate using a transfer pad. The underlying tag or "substrate" for the decoration is a smooth-surfaced soft polyvinylchloride or rubberized material with appropriate ink-receptive or attractive characteristic—such as a matte or semi-gloss surface finish. The item is placed on a supporting surface in a pad printing device so that the substrate is restrained within a registration jig; an inked image on a plate is contacted with a printing pad and the pad is moved to contact the substrate, thereby applying the custom decoration thereto. In one embodiment, the substrate is secured by cords to a side of the item. The substrate is constructed from a pliable material, such as rubberized polyvinylchloride, with custom ink decoration applied thereto. The opposing ends of the substrate include tabs that are secured around each of opposing cords. Likewise, a substrate can be secured along an edge of an item by adhesives or stitching. This edge can be that of an outer pocket.

21 Claims, 11 Drawing Sheets

DECORATION FOR BAGS AND CASES AND METHOD FOR APPLYING THE SAME

RELATED APPLICATIONS

The present application is related to the teachings of commonly assigned co-pending U.S. Design Pat. No. D492,485 S issued on Jul. 6, 2004, by Agnes Csilla Domotor et al. for DECORATION FOR BAGS AND CASES, which are expressly incorporated herein by reference.

BACKGROUND OF THE INVENTION

1. Field of the Invention

This invention relates to bags, portfolios, padfolios and other business accessories, and more particularly, to customized decorations applied to such items and the application of such decorations.

2. Background Information

It is often desirable to apply decorative printing to cases, bags, portfolios and other business accessories. These items, often crafted from natural or synthetic leather, may carry a predefined location for applying a decoration. In a common application, the decorative printing consists of a promotional logo (e.g. a company trademark or trade name) and/or the owners name or monogram. Where a decoration is applied in bulk to a line of business accessories by a vendor, the decoration may be manufactured ahead of time by applying the decoration to an appropriate patch or substrate. This decorative substrate is then subsequently bound to the item using adhesives or stitching. The substrate may be a patch formed from a soft plastic or rubber compound with a painted or molded color pattern on its outer surface.

However, where a separately formed substrate or patch is used, the business accessory must often undergo a final construction step to attach the decoration-bearing substrate its outer surface at the appropriate location. This takes time and necessitates that a ready inventory of both business and decorated substrates be kept on hand for final finishing. If a customer purchasing decorated business accessories wishes to change the decoration, or increase the size of the order beyond the number of decorated substrates in stock, then the order must be delayed until a new stock of decorated substrates is received from a manufacturer. Clearly, the use of pre-manufactured decorative patch or substrate may limit manufacturing speed and flexibility for vendors of business accessories and their responsiveness to changing customer wishes.

SUMMARY OF THE INVENTION

This invention overcomes the disadvantages of the prior art by providing a decoration for bags, cases, portfolios and other business accessories (the "item") that can be printed at an appropriate location directly on the otherwise-finished item. The decoration comprises a single or multi-colored ink image transferred from a lithographic plate using a transfer pad. The underlying tag or "substrate" for the decoration is a smooth-surfaced soft polyvinylchloride or rubberized material with appropriate ink-receptive or attractive characteristic—such as a matte or semi-gloss surface finish.

A procedure for applying the decoration includes (a) placing the item on a supporting surface in a pad printing device so that the substrate is restrained within a registration jig; (b) inking a decorative image formed on an etched plate; (c) contacting the inked image with the pad to transfer the ink to the pad in the form on the decorative image; and (d) moving the printing pad so that it is aligned with the jig and directing its printing stroke onto the restrained substrate. As each item is printed, it is removed from the support and a new, undecorated item is replaced on the support.

The procedure for producing a decorated bag can include the provision by the customer of a decorative logo or other design by photograph, sample or electronic image (using, for example, e-mail or a World Wide Web link). Information regarding the number and type of items to be decorated is also provided. The design is enlarged or reduced to the appropriate size using compute-aided graphics applications. Alternatively, photographic or photocopier-based resizing techniques. The side is made to fit the substrate by this technique. The image is then projected onto a photosensitive plate and etched with an etching solution according to using conventional photo-etching techniques. The plate includes a registration hole or slot for proper alignment with the printing machine. After decoration, items are forwarded to the requesting customer.

In one embodiment, the substrate is secured by cords to a side of the item. The substrate is constructed from a pliable material, such as rubberized polyvinylchloride, with custom ink decoration applied thereto. The opposing ends of the substrate include tabs that are secured around each of opposing cords. Likewise, a substrate can be secured along an edge of an item by adhesives or stitching. This edge can be that of an outer pocket.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
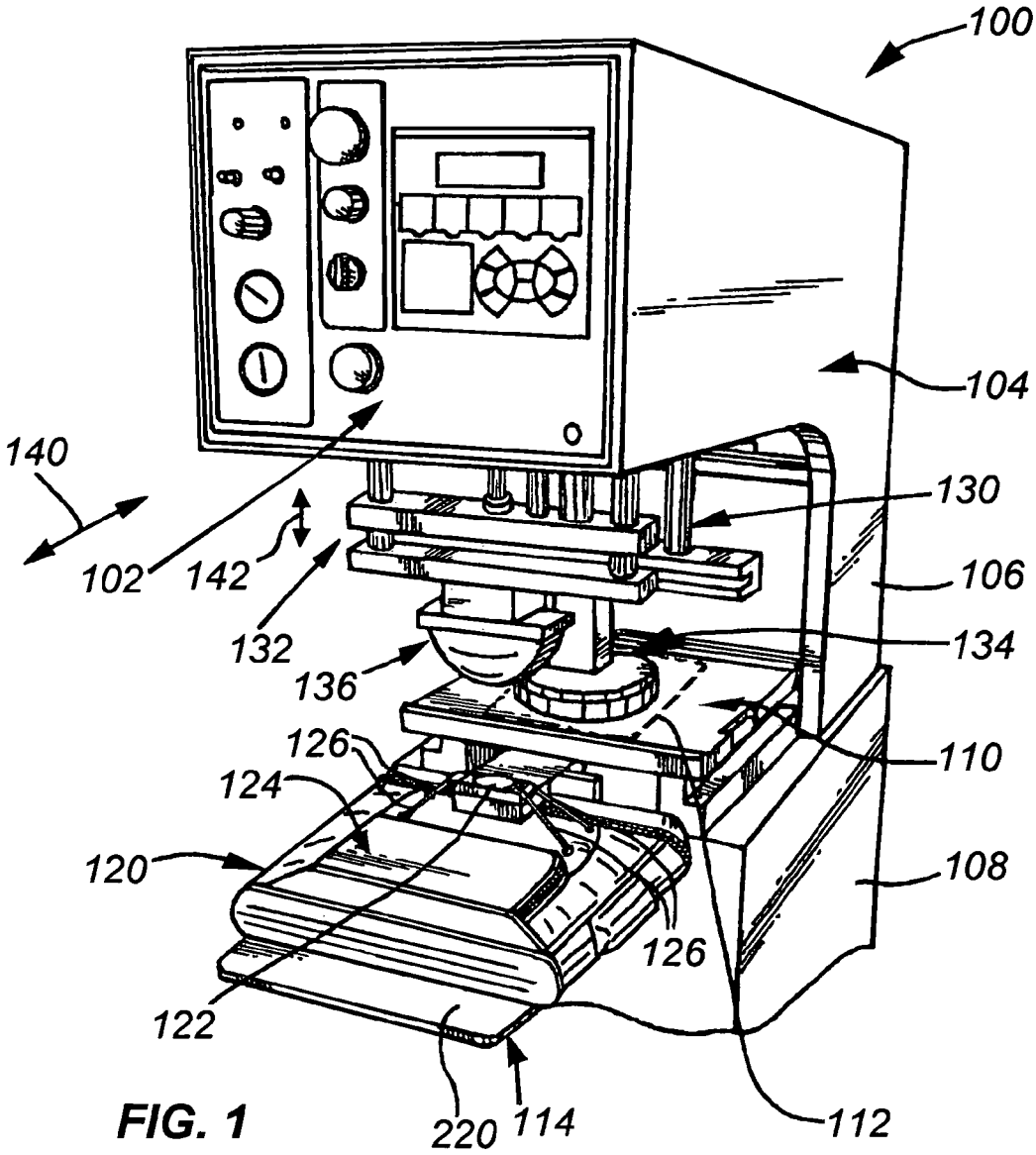
FIG. 1 is a perspective view of a pad printing machine with a bag mounted therein for printing in accordance with an embodiment of this invention.

FIG. 1 shows a pad printing machine 100 for use in producing custom decorations on bags, cases and other business accessories ("items") according to an embodiment of this invention. The printing machine 100 is an example of a variety of commercially available machines that can be used in accordance with this invention. Other machines can include a greater or lesser level of automation, and/or can operate at slower or faster speeds. The exemplary printing machine 100 in this embodiment is a GS-200S Servo Drive Pad Transfer Printer. It is commercially available from ITW Imtran of Haverhill, Mass. This particular machine is programmable so that movement of its printing elements can be varied according to a preset pattern. A control panel 102 is used to input movement functions as well as other operational parameters. Various functions are monitored by appropriate gauges and indicators on the panel 102. The panel is part of an upright, overhanging beam 104, that extends on a pylon 106 from a base 108. The upper portion of the base 108 includes an inking section 110. Within the inking section is located a registered with a graphic plate 112 (shown in phantom) upon which an appropriate image is engraved in full size (relative to the printed image). The plate and image are described in further detail below.

Outboard of the inking section 110 is located an item support base 114 according to an embodiment of this invention. The item support base 114 supports the item to be decorated. In this illustrative embodiment, the item is an exemplary bag or case bag 120. The exemplary bag 120 is constructed from woven fabric, natural or imitation leather or any other acceptable material, and includes a central substrate 122 provided on a front face 124 of the bag 120, and secured to the face 124 by four elastic cords 126 that are anchored through grommets in the side of the bag. This substrate is described in the above-referenced co-pending U.S. Design Pat. application Ser. No. 29/182,660, the teachings of which are expressly incorporated herein by reference. In this embodiment, a pair of moving actuators 130 and 132 carry, respectively, an inking pad 134 and a printing pad 136. As described below, each actuator is capable of movement horizontally (double arrow 140) along the overhanging beam 104 and vertically (double arrow 142), perpendicular to the beam's direction of outboard extension from the pylon. In this example, the horizontal stroke of the actuators along the beam is adjustable between approximately 4 and 8 inches. The vertical stroke is adjustable to approximately 5 inches.

As will be described further below, an exemplary printing machine can be adapted to accommodate a multiplicity of colors, each typically provided as separate etched formation on the plate 112. In this instance, each etched formation on the plate 112 is inked by a separate (individually colored) section of an inking pad and, may printed by a separate portion of the printing pad 136. The horizontal stroke is adjusted so that the proper ink pad and printing pad locations strike the proper etched formation of the plate to generate the desired overall multi-color image.

Figure 2:
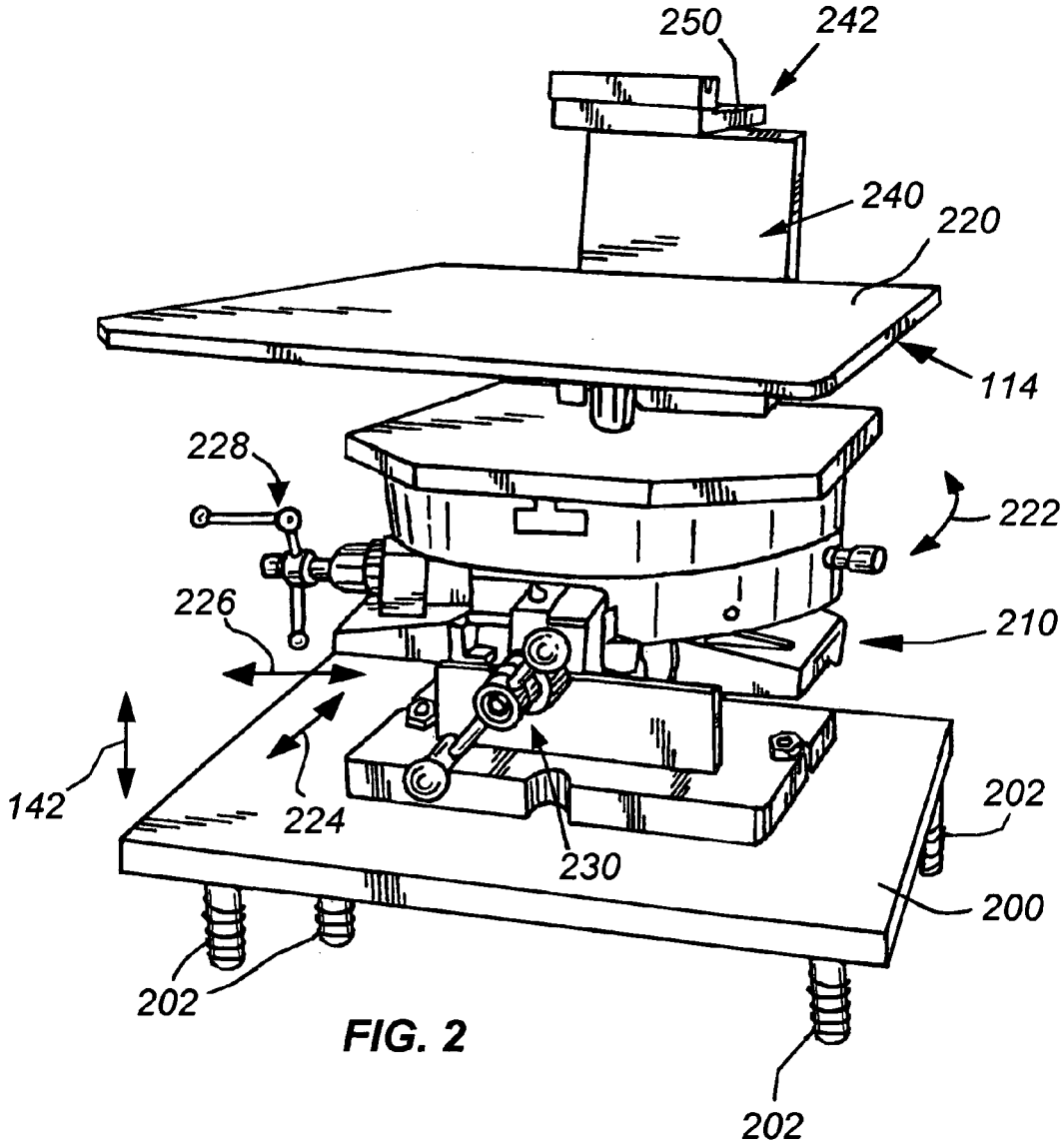
FIG. 2 is a more detailed perspective view of the support base of the pad printing machine of FIG. 1.

With further reference to FIG. 2, the base 114 for supporting the item is shown in further detail. The base 114 is mounted on a vertically moving support structure 200 that can be translated upwardly and downwardly (double arrow 142) by simultaneous driving of four jack screws 202, one mounted adjacent to each corner of the support 200. The jack screws 202 are exemplary and a variety of lifting mechanisms, including a hydraulic lift assembly, can be substituted. On the support structure 200 is also mounted an indexing head assembly 210. The indexing head 210 allows the main item support base 220 to be rotated (curved double arrow 222) within a predetermined arc. Likewise, the indexing head can include advancing screws for final adjustment the support plate 220 in each of a pair of orthogonal horizontal directions (double arrows 224 and 226). Adjustment handles 228 and 230 can be provided to facilitate movement of the indexing head.

Figure 3:
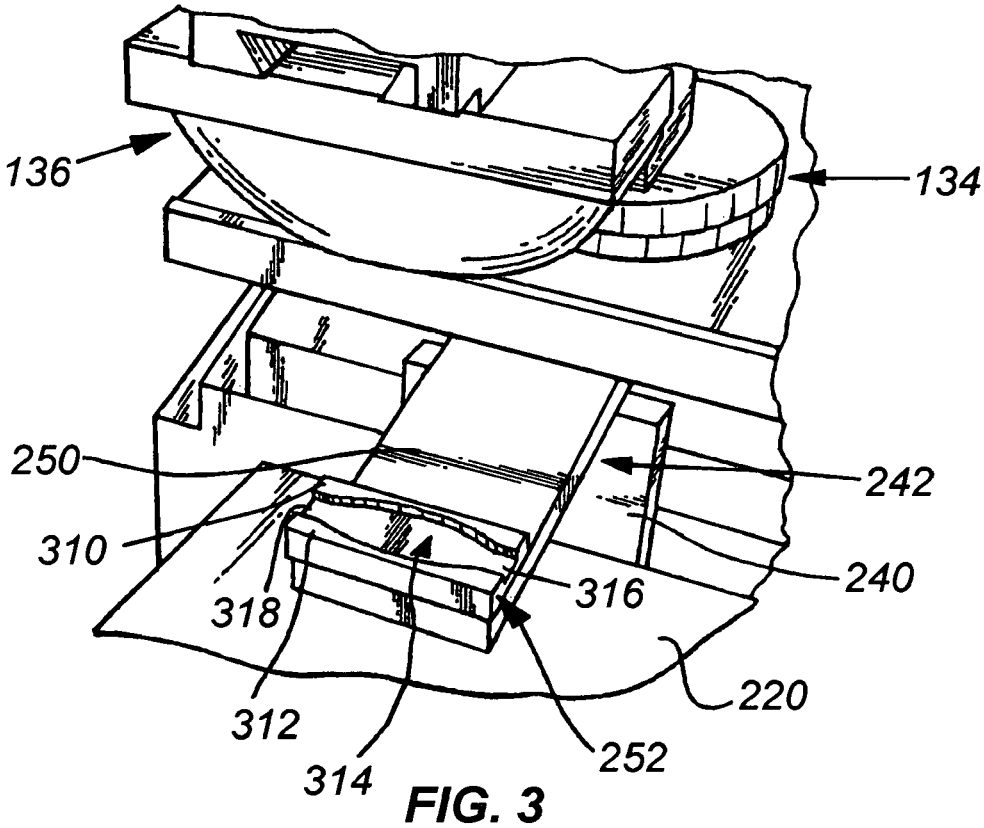
FIG. 3 is a perspective view of a jig for retaining a tag or substrate and the associated printing pad according to an embodiment of the invention.

Attached to the rear (inboard side) of item support plate 220 is an upright member 240 having, at its uppermost edge, a jig assembly 242. The jig assembly 242, according to this embodiment, is shown in further detail in FIG. 3. It consists of an outwardly extending bracket 250 having, at its end, a well structure 252. The well structure is raised above the bracket 250 and includes a pair of front and back walls 310 and 312 that define therebetween an inner well or channel 314 with opposing open ends 316 and 318.

Figure 4:
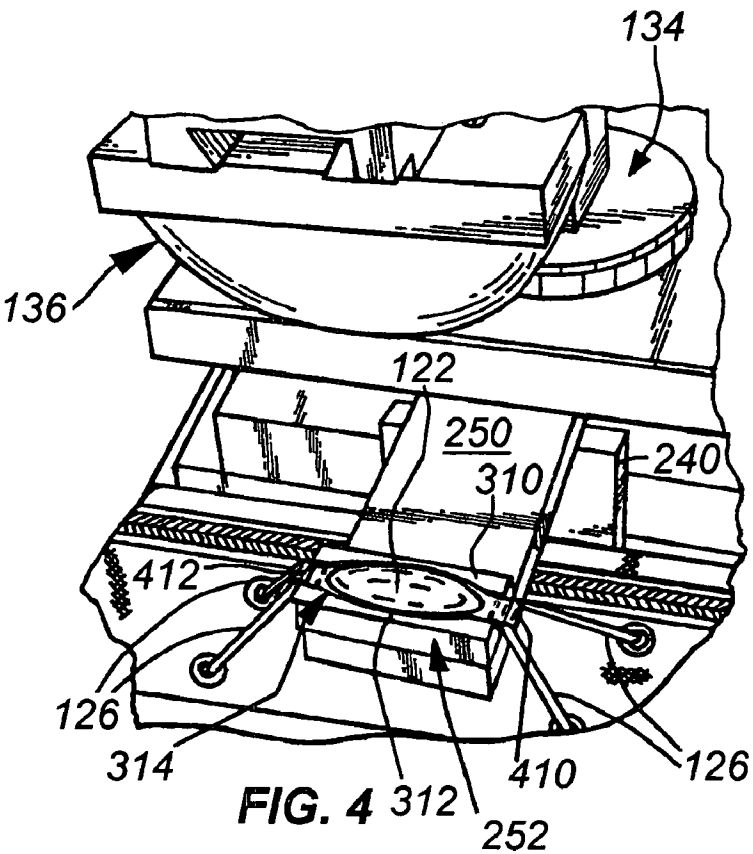
FIG. 4 is a partial perspective view of a bag having a substrate restrained in the jig of FIG. 3 for printing.

With further reference to FIG. 4, the well 314 is sized and arranged to accurately receive the tag or "substrate" 122 whereby the walls 310 and 312 restrain the substrate from lateral movement while the end extensions 410 and 412 of the substrate extend outwardly from the open ends 316 and 318, respectively. The particular substrate 122 in this example defines an ovular outline, with a semi-domed surface. It is contemplated that a variety of unique substrate shapes can be provided. Where alternate shapes are provided, the well structure has a length and width sufficient to surround the parameter of the substrate and also has walls that are sized-and-arranged to accurately receive and register the substrate therein. Note that the well's walls (walls 310 and 312) have a height above the well that is generally less than the height of the (domed) surface of the substrate. In this manner, as described further below, the printing pad 136 can accurately transfer its printing ink to the surface of the substrate without unduly engaging the walls. Note also, in this embodiment, the end extensions 410 and 412 are strips of substrate material that are rolled over the elastic cords 126 and joined by stitching (as shown) or another attachment mechanism. The substrate can be a unitary piece of material, or can be formed from a separate base that includes the extensions 410 and 412 having a domed decorative element adhered thereover.

Figure 5:
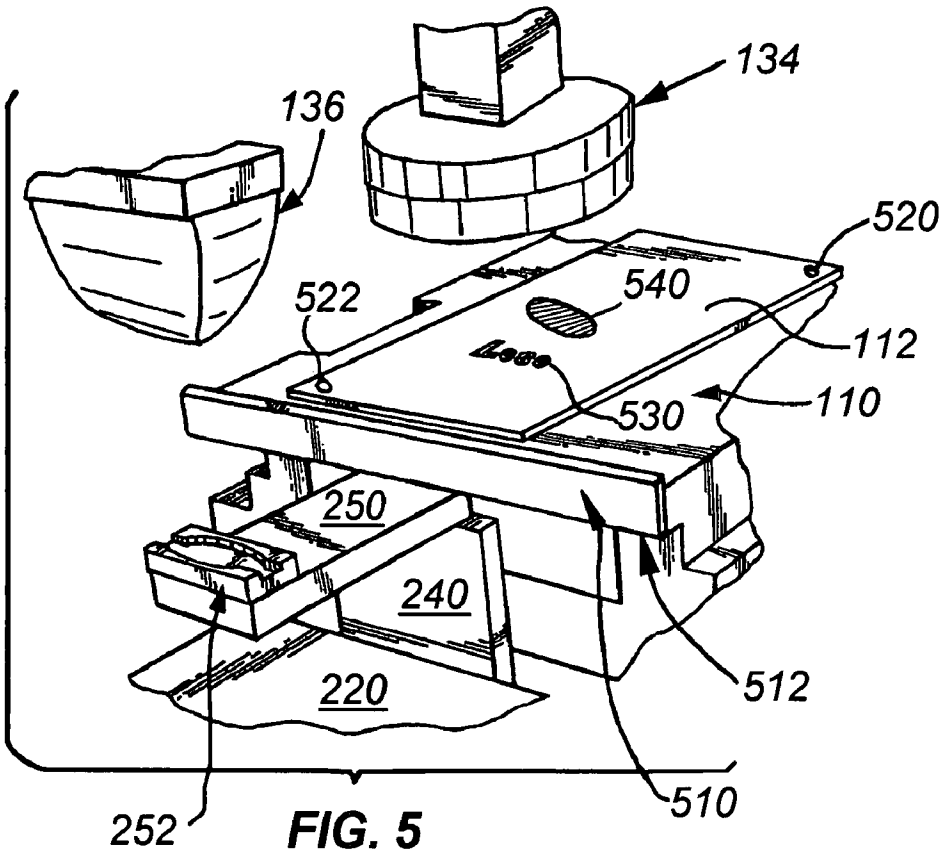
FIG. 5 is a perspective view of the jig, printing pad, inking pad and lithographic plate according to the embodiment of FIG. 3.

With reference now also to FIG. 5, that the inboard base 110 of the exemplary printing machine 100 includes an overhang 510 with a bottom shoulder 512. The extension 250 can be sized and arranged so that it contacts the bottom shoulder 512 when the jig assembly is raised to an appropriate height for printing. This simplifies height registration during machine set-up.

Also with reference to FIG. 5, the lithographic plate 112 is shown in further detail. The plate 112 includes one or more registration holes 520 and 522 that engage appropriate alignment pins on the base 110. Alternate registration techniques can be substituted. In general, a lithographic plate is constructed by exposing an undeveloped plate that is coated with a chemical photo-resist layer to light in the pattern of the desired printed etched formation. In this example, a pair of distinct etched formations 530 and 540 are provided. However, in the simplest case, a single printed formation is provided at the appropriate location. Alternatively a large variety of printed formations can be provided. Each formation can represent a particular color or pattern to be printed. These can all be printed on the same substrate or different individual patterns/combinations of patterns can be printed on different substrates selectively. As noted above, the inking pad 134 can carry a single ink color, or can be bifurcated to carry into a variety of different colors, each contacting the appropriate formation under control of the horizontal stroke of the machine.

The exemplary printing process described further below relates to printing of a single-color decoration. However, the process to-be-described can be repeated so as to produce multi-colored decorations. Briefly, once a plate is exposed to a particular light pattern it is etched by rinsing it in a corrosive bath or wash. The bath or wash corrodes the areas that have been exposed to light because the photo-resist has undergone a chemical change in those areas so as to be susceptible to the etching solution. Alternatively, the photo-resist is not susceptible to decomposition in areas that have not been exposed to light. The decomposed areas become a well into which ink can be driven by the pad 134 for transfer to a smooth printing pad 136. This process is generally termed "offset" printing since the printed pattern is offset from the plate onto an intermediate pad 136 that performs the actual printing. As noted above, where multiple colors are printed, the movement of the printing pad 136 is programmed to strike each formation at the appropriate place, and in the appropriate order, so as to lift the desired ink pattern and transfer it to the substrate. Notwithstanding the foregoing description of a photo-etched plate, it is contemplated that any type of printing plate that permits transfer of ink selectively to a printing pad can be employed. Such plates can include plastic printing plates with a coating that becomes selectively ink-resistant and ink-attractive based upon to selective exposure to light, etc. The term's "photo-lithographic plate" and/or "printing plate" should, therefore, be taken broadly to include a variety of print-transfer plates that interact with an offset printing pad. Additionally, while an offset printing process is described herein, in an alternate embodiment, the printing formation can also be provided directly to an appropriate printing pad that is simply inked, and applied to the substrate so as to print the desired decoration in the manner of a stamp.

Figure 6:
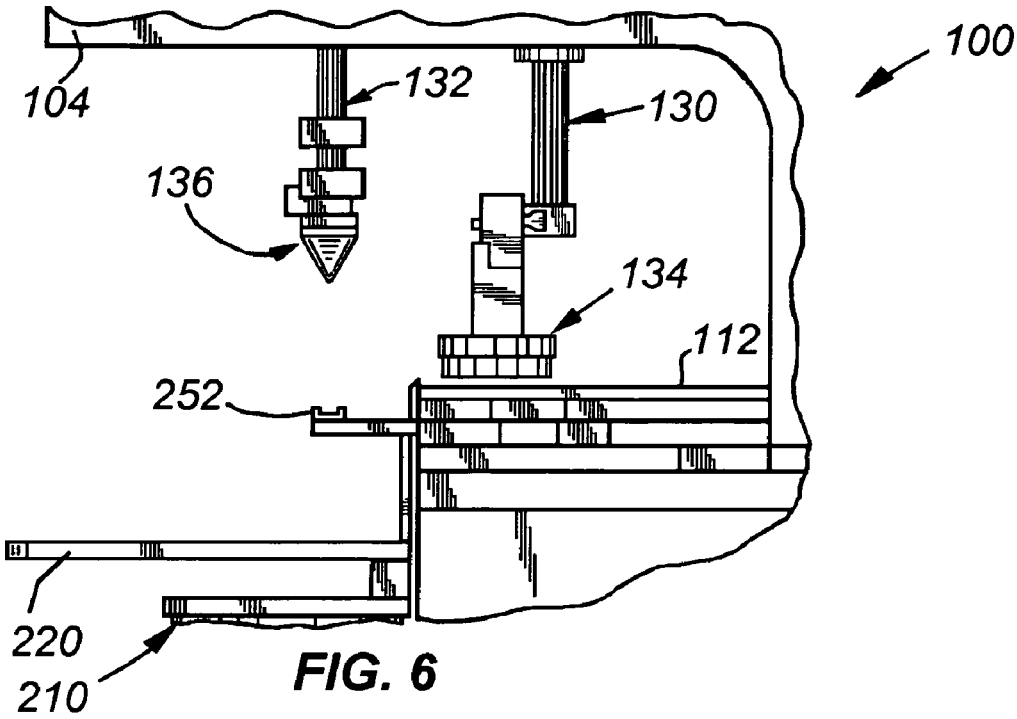
FIG. 6 is a side view of the printing machine arranged in accordance with the embodiment of FIG. 3 during a printing process prior to loading a case or bag with a substrate onto the support base and jig, respectively.

Having described an exemplary arrangement for a pad-printing device according to an embodiment of this invention, a procedure for pad-printing a substrate with an appropriate decoration will now be described in detail. Referring to FIG. 6, the pad printing machine 100 is shown in partial side view, with emphasis on the operative elements including the plate 112, inking pad 134, printing pad 136, support base 220 and jig well structure 252 for receiving the decoration or substrate. In FIG. 6, the machine 100 is shown unloaded and ready to begin printing.

Figure 7:
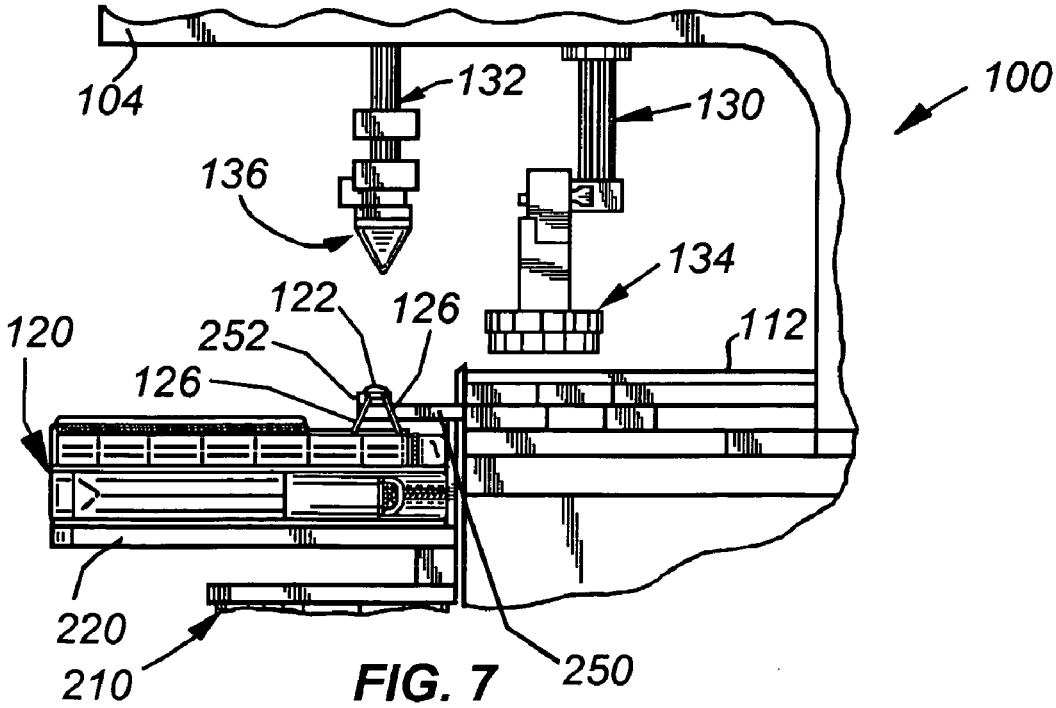
FIG. 7 is a side view of the printing machine arranged in accordance with the embodiment of FIG. 3 during a printing process immediately after loading a bag with a substrate onto the support base and jig.

In FIG. 7, an exemplary case or bag 120 has been loaded onto the item support 220. The jig assembly is sized so that the front portion of the case or bag 120 passes in an inboard direction under the jig extension arm 250. In this position, the substrate 122 is aligned with respect to the well 252. The elastic cords 126 are stretched as the bag is passed under the extension 250 so that the substrate can be slipped onto the well structure 252. In this position, the weight of the case 120 applies tension to the cords 126 to generate holding pressure between the substrate 122 and the well structure 252. It is contemplated, however, that the well can have sufficient wall height to freely hold the substrate in absence of tension exerted by the cords 126.

Figure 8:
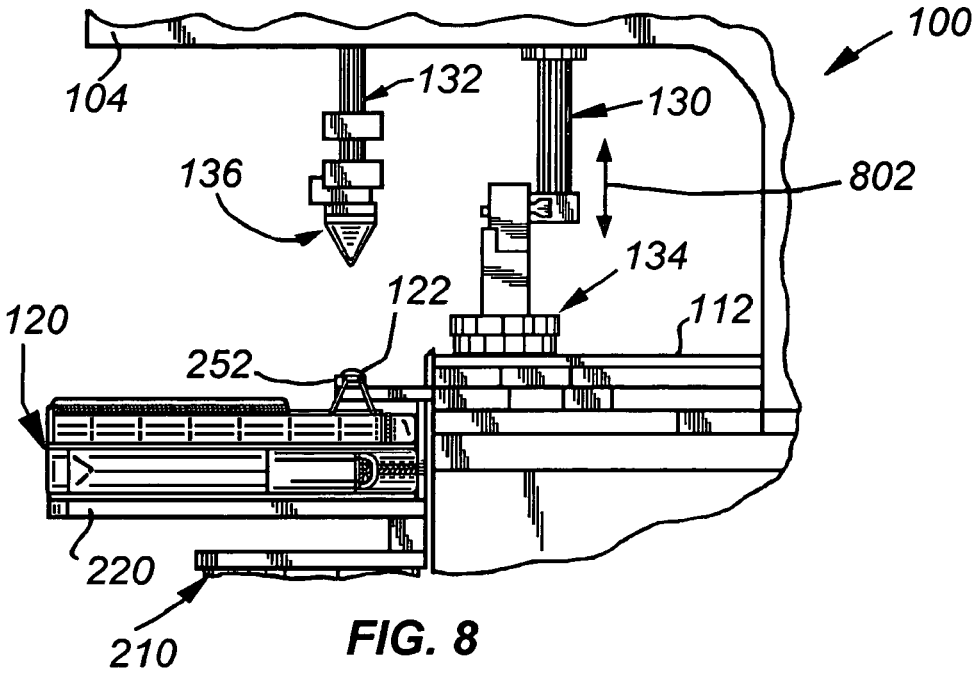
FIG. 8 is a side view of the printing machine arranged in accordance with the embodiment of FIG. 3 during a printing process showing the inking pad transferring ink to the lithographic plate.

Having mounted the bag, FIG. 8 shows the inking pad 134 moving downwardly (double arrow 802) into contact with the etched area of the plate 112. This motion transfers ink from the pad into the plate's etched area.

Figure 9:
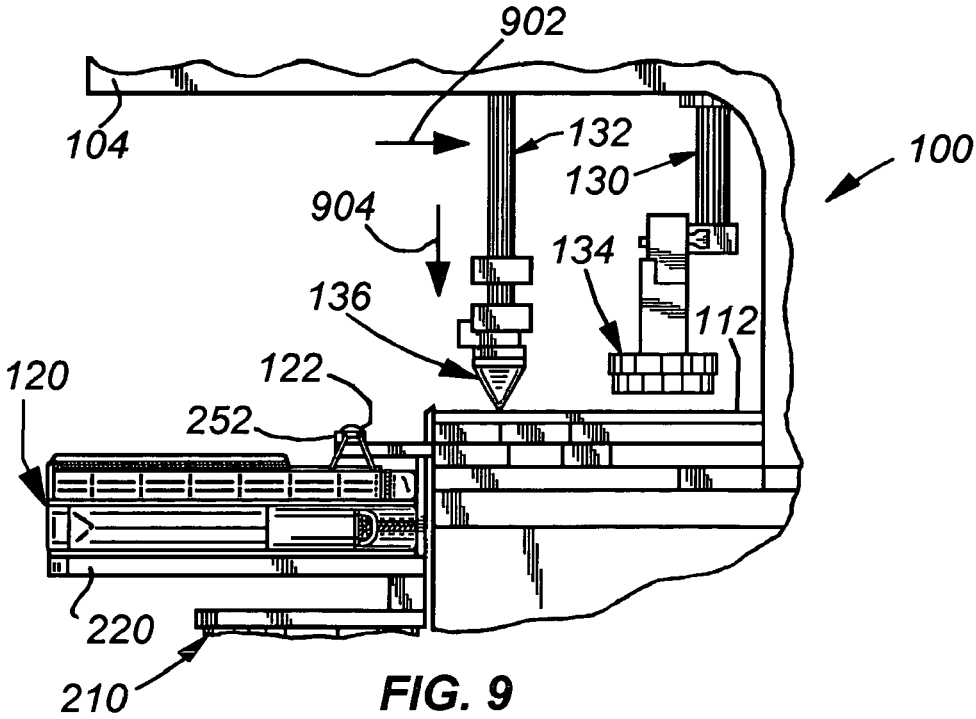
FIG. 9 is a side view of the printing machine arranged in accordance with the embodiment of FIG. 3 during a printing process showing the printing pad in engagement with the lithographic plate so as to transfer an inked image therefrom.

Next, in FIG. 9, the inking pad 134 and printing pad 136 move rearwardly (arrow 902) along the beam 104 so that the printing pad 136 is positioned over the etched area of the plate 112. During movement, the inking pad 134 remains separated from the plate 112 as shown. Likewise, the printing pad, remains separated and then is brought downwardly (arrow 904) into contact with the etched section. At this time, the surface of the printing pad picks up ink from the etched section in the pattern of the etching. This corresponds to the pattern to-be-printed on the substrate 122.

Figure 10:
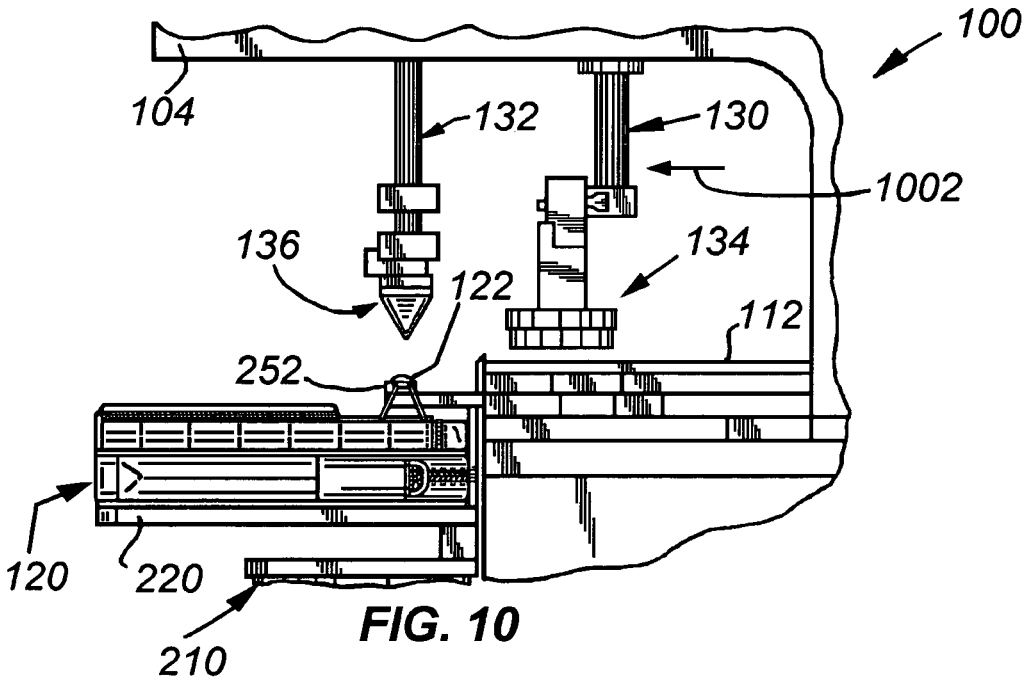
FIG. 10 is a side view of the printing machine arranged in accordance with the embodiment of FIG. 3 during a printing process showing the printing pad just prior to printing the substrate using the printing pad.

In FIG. 10, the inking pad 136 has moved upwardly out of contact with the pad and the two pads 134 and 136 have been brought forward (arrow 1002) so that the printing pad 136 directly overlying the substrate 122.

Figure 11:
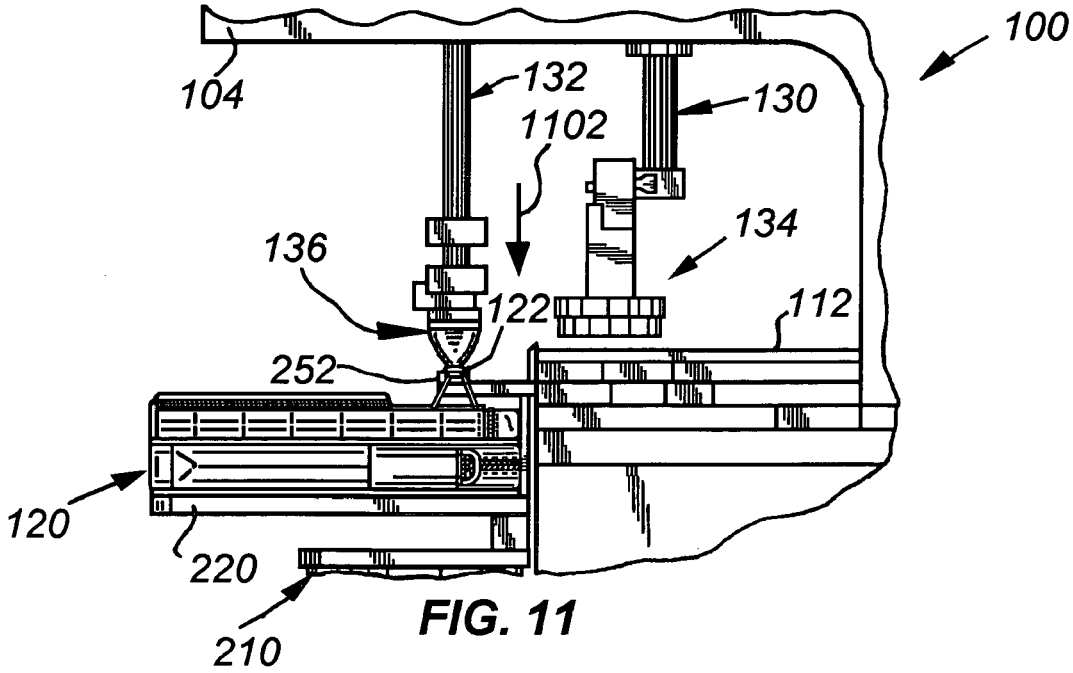
FIG. 11 is a side view of the printing machine arranged in accordance with the embodiment of FIG. 3 during a printing process showing the printing pad immediately after printing the substrate using the printing pad.
Figure 12:
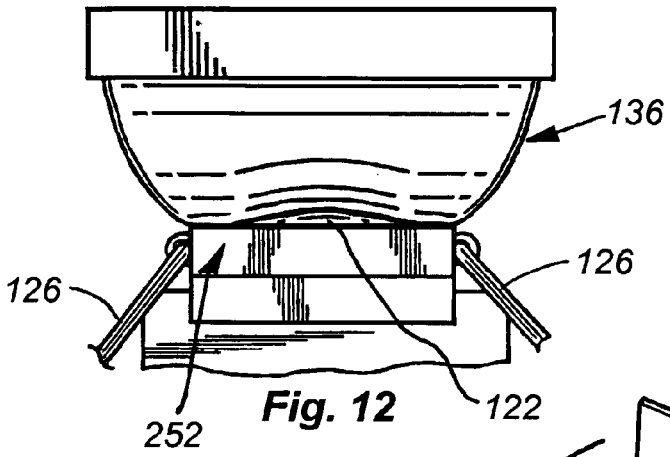
FIG. 12 is a partial side view of the printing pad in engagement with the substrate in accordance with FIG. 11.

Finally, in FIG. 11, the printing pad 136 is brought into contact with the substrate 122 (arrow 1102) to transfer the ink on the printing pad 136 onto the substrate. While not shown, the inking pad 134 can also be brought down onto the etched section at this time or can be brought down at a later time during the cycle. After printing, the printing pad 136 withdraws (as shown in FIG. 7) allowing the newly printed decoration to be removed from the well 252. As shown, the pad exhibits a mostly triangular side profile, with a blunted bottom. Likewise, as shown generally in FIG. 3, the frontal profile of the pad is semi-circular. When coming into contact with either the etched section or the decoration (see FIG. 12) the pad compresses and deforms. This form of offset printing is particularly effective for transferring an undistorted pattern to a non-planar substrate surface. In general, this depicted shape has been found to be effective in laying printing ink accurately onto a domed substrate such as the substrate 122 shown in FIG. 12. It is contemplated that other pad shapes can be employed. The precise shape can be varied based upon, among other factors, a trial-and-error determination of the best result for a given substrate shape. In other words, attempts to print a given substrate with differently shaped pads are made, and the pad that produces the best result is chosen. In this embodiment (given a substrate with dimensions of approximately 1½ inch by ¾ inch) the pad is approximately 3–4 inches at its widest point in frontal view and is approximately 1½–2 inches at its widest point in side view. It tapers to a curved/blunted area that has a radius of approximately ½–¾ inch in side view and approximately 3–4 inches in frontal view. However, these measurements are approximate and can be varied.

Figure 13:
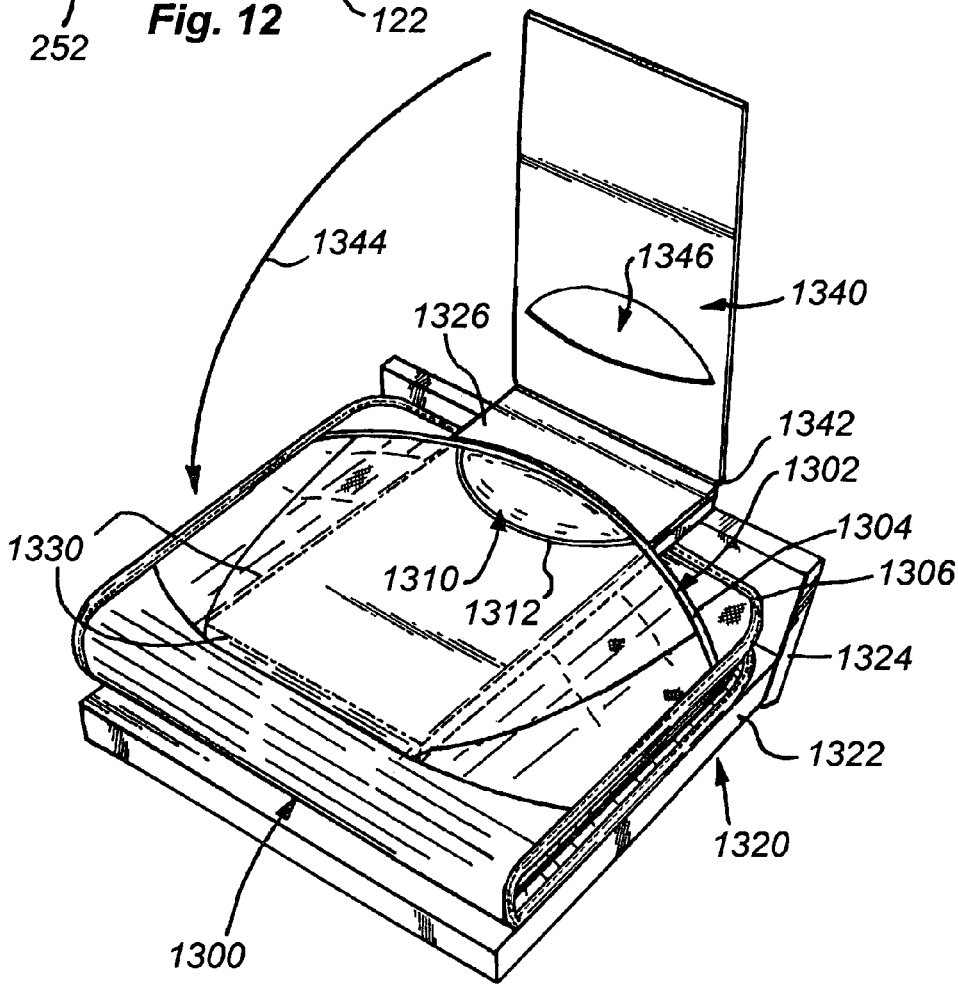
FIG. 13 is a perspective view of a support base and jig for use with the pad printing machine of FIG. 1 shown prior to securing a case with a substrate according to an alternate embodiment.
Figure 14:
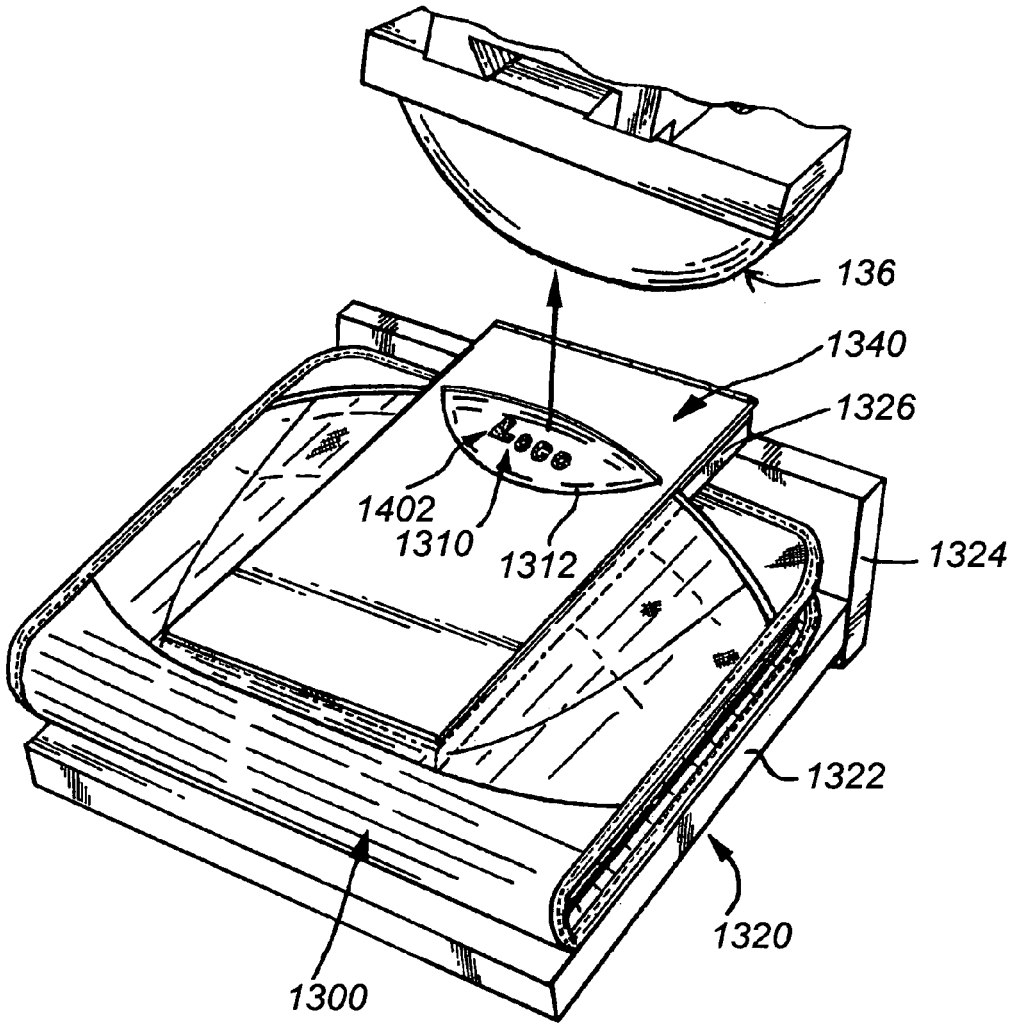
FIG. 14 is a perspective view of the support base, jig and case according to FIG. 13 immediately after printing of the substrate by the printing pad.

FIG. 13 details a case 1300 or portfolio/padfolio according to an alternate embodiment. In this embodiment, an outer pocket 1302 is provided. The outer pocket has an edge 1304 remote from the perimeter edge 1306 of the case top. Within a central region of the pocket edge is provided a substrate 1310. This substrate is semi-circular along its bottom edge 1312 and conforms along its top to the pocket edge 1304. It can be attached by adhesives or stitching, or by another suitable technique. It is formed from a rubberized polyvinylchloride or another suitable material. A specialized support base for use with the above-described pad printing machine (or another acceptable printing device) is shown. The support base 1320 includes a bottom base section 1322, a raised wall 1324 and an extended arm section 1326 under which the case 1300 is slid. The pocket 1302 is, rather, slid over the arm 1326 so that the arm extends into the pocket as shown in phantom (phantom line 1330). In order to enhance registration of the substrate 1310 with respect to the overlying printing pad (not shown, but similar in form to the pad 136 above), a hinged retaining plate 1340 is provided. The plate 1340 rotates about a hinge 1342 (as shown by curved arrow 1344). The plate includes an aperture 1346 having a perimeter edge sized to match the outer edge of the substrate 1310. As shown in FIG. 14, when the retaining plate 1340 is lowered into position, it effectively captures the perimeter edge 1312 of the substrate 1310. This enables the printing pad 136 to be accurately be registered with respect to the substrate 1310. Accordingly, a decoration 1402 is accurately printed on the substrate 1310 by transfer of ink from the printing pad 136.

Figure 15:
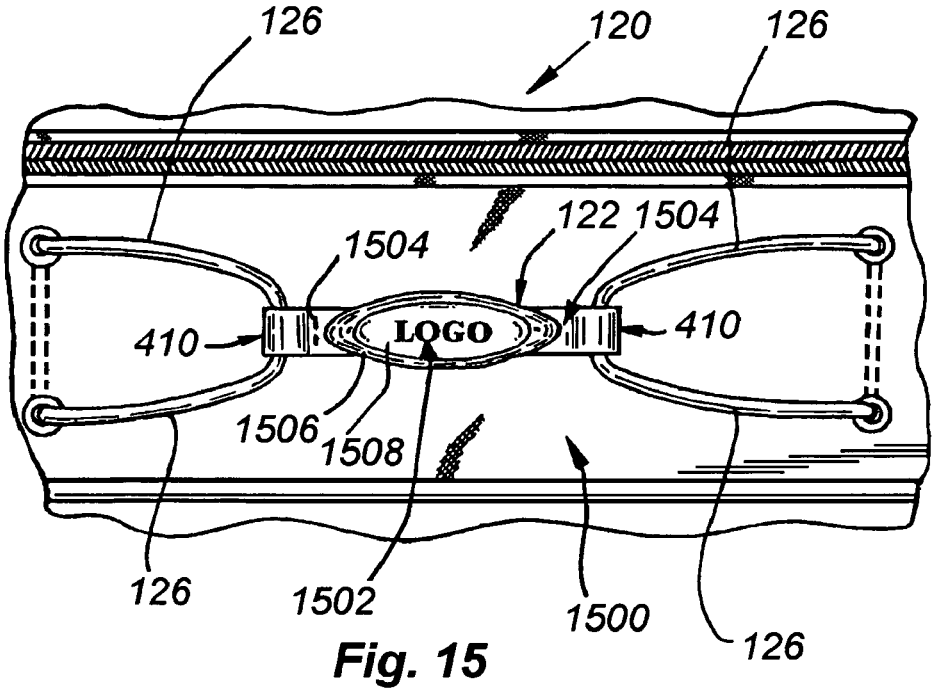
FIG. 15 is a partial side view of a bag containing a printed substrate in accordance with the embodiment of FIG. 3.
Figure 16:
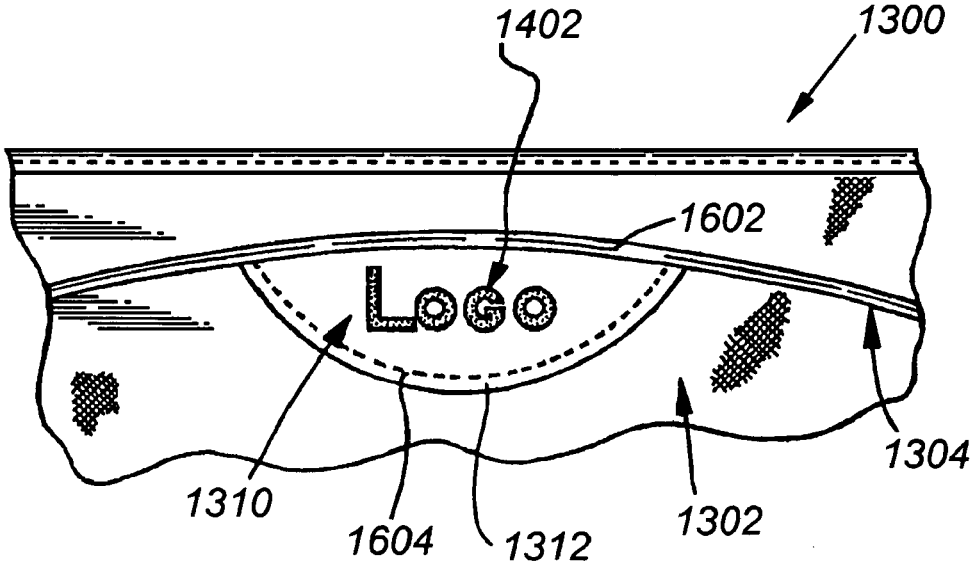
FIG. 16 is a partial side view of a case containing a printed substrate in accordance with the embodiment of FIG. 13.

FIGS. 15 and 16 show, in further detail, two examples of decorative printed substrates or substrates 122 and 1310, respectively, that can be produced in accordance with this invention. Each decoration 1502 and 1402 on the respective substrate 122 and 1310 to be printed in one, or a multiplicity of colors and in a variety of shapes and styles.

In FIG. 15, the cord-attached substrate 122 includes extensions 410 that, as described above, are attached to the cords 126 (both parts of a single, continuous length of elastic or "shock" cord in this example) by loops secured with stitching 1504. The cords 126 extend through the face 1500 of the exemplary case or bag 120. Beneath the face 1500, they can be joined as shown in phantom. The substrate's extensions are unitary (e.g. molded as one part) with the central ovular base 1506. A raised central domed surface 1508 is attached to the base. The domed surface can be unitary the base 1506, or can be separately attached with adhesives, welding, etc. The domed surface 1508 can be a different color relative to the base 1506.

In FIG. 16, the padfolio or portfolio 1300 includes a pocket 1302 with a perimeter edge 1304. This edge is bonded with a piece of piping 1602 in this example. The substrate 1310 is secured to the pocket 1302 using stitching 1604 that extends around the perimeter of the substrate away from the pocket edge 1304. The upper edge is covered by the piping, but may also be stitched to the pocket. Alternate securing techniques, such as adhesives, can be used instead of, or in addition to stitching, to secure the substrate to the item.

As noted generally above, the substrate generally consists of a rubberized polyvinylchloride with, typically, a matte or otherwise non-glossy surface. To this surface is provided an ink mixture suitable for such materials. These ink compositions are commercially available, and can consist mainly of the following compounds:

| Compound: | Concentration: |
|---|---|
| cyclohexanone | 10–20% |
| butylglycolate | 10–20% |
| diacetone alcohol | 5–10% |
| N-butyl acetate | 5–10% |
| 1-methoxy propylacetate-2 | 5–10% |

This composition includes appropriate pigments and is commercially known as ink type PGNT, available from Trans Tech America, Inc. of Carol Stream, Ill.

This ink can be combined with appropriate thinners and retarders. A commercially available thinner from Trans Tech America, Inc. is known as Thinner B and includes butyl acetate, xylenes, cyclohexanone and 1-methoxy propylacetate-2 in appropriate concentrations. Likewise, a commercially available retarder is known as Retarder TPD available from Trans Tech America, Inc. and includes 65–75% ethyldiglycolacetate along with 25–30% aromatic hydrocarbons.

A composition of inks and substrates can be varied, and those described above are only exemplary variety of combinations. Likewise, the placement and shape of substrates and substrates and printed decorations can be highly varied. Additional wells and retaining devices can be applied to a jig assembly for holding such substrates or substrates in place for appropriate registration during printing.

Figure 17:
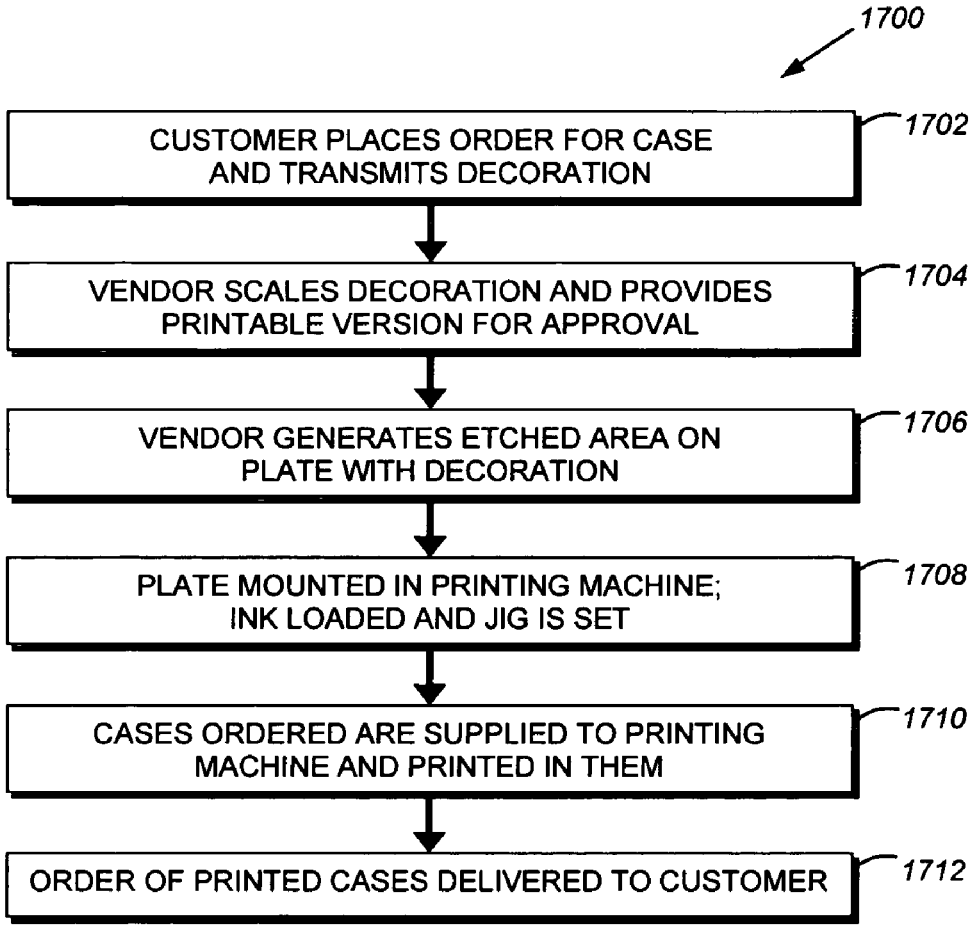
FIG. 17 is a flow diagram of a procedure for producing bags, cases or other business accessories with custom-printed decorations according to an embodiment of this invention.

Having described the mechanism and generalized procedure by which printing of customized decorations on bags, cases or other business accessories occurs, reference is now made to FIG. 17, which describes the generalized procedure 1700 for ordering and producing such bags. Initially, a customer may browse on-line or printed catalogs for products supplied by the vendor that can be customized using the decoration procedures described herein. This browsing process can also be performed using an Internet-based system, such as that described in commonly-owned U.S. Pat. No. 6,414,693, the teachings of which are expressly incorporated by reference. When a decision has been made as to the type and quantity of items to be ordered, the customer then places this order using a telephone, electronic mail, a physical purchase order or another electronic order-transmission technique (for example secure socket link (SSL) Internet communication in accordance with step 1702 of the procedure 1700. In addition, the customer transmits the desired artwork from which a decoration is rendered. This can be performed by physical delivery (mail, etc.), or electronically by transmitting an image of the decoration in an appropriate file format (for example, Bitmap or compressed JPEG format). The decoration may already be on file from previous interaction between the customer and the vendor. In this case, the customer simply selects which decoration it wishes to apply.

In step 1704, the vendor receives the order and confirms that the type and number of customized cases can be provided. This may involve a check of inventory and/or outside suppliers of undecorated items for availability. Assuming the order can be filled, the vendor then manipulates a transmitted copy (or previously stored copy) of the decoration for printing on the selected item(s). The image of the decoration is thereby appropriately sized and scaled to fit within the confines of the desired substrate. This scaling can be performed using a commercially available graphic arts software application, or using conventional photo enlargement or reduction techniques.

Next, in step 1706, the vendor projects a version of the desired, properly scaled decoration onto a photolithographic plate. This can be accomplished by any number of a variety of conventional exposure techniques. The exposed plate is etched to create the ink-attractive surface and then readied for use in the printing machine. Next, in step 1708, the plate is mounted in the printing machine. One or more colors are loaded onto an inking pad and the appropriate jig is set. Where only a few different types of substrate are used, there may be dedicated machines, each having a dedicated jig for that particular type of substrate. Otherwise, the machine is provided with the appropriate jig.

In step 1710, the selected items are made ready for printing (being received from a supplier or brought forward from the stock room) and are supplied to the printing machine for printing, in serial fashion. Again, printing may involve application of a single color, or application of multiple colors involving transfers from different etched features, each carrying a different ink color.

Finally, when all or acceptable portion of the order is fulfilled, the completed, decorated items are forwarded to the customer. It is contemplated that the above procedure 1700 can be varied to account for different circumstances. For example, a customer may require that a certain case be printed with several different available decorations, requiring changes in the plate and/or ink during the production run. Similarly, the customer may require the same decoration printed on a variety of different products, requiring different machines and/or jigs to be used a various times. Likewise, decoration artwork can be provided in a variety of ways including physical samples from which art is rendered by the vendor and then scaled appropriately for transfer to a plate.

It should be clear that the system and method for printing custom bags, cases and other business accessories described above allows maximum versatility in the order customization process. The customer or vendor need not pre-order a large quantity of pre-decorated substrates for later application to items—rather the vendor can supply on-demand exactly the number of decorated bags needed with no excess. In other words, these decorated items can be produced on-demand by the vendor out of a stock of standardized items having a pre-defined printing area. If, during the order process, the customer wishes to change the size of the order or change the decoration, he or she is free to do so without need to obtain a different or increased supply of decorated substrates.

The foregoing has been a detailed description of illustrative embodiments of the invention. Various modifications and additions can be made without departing from the spirit and scope of the invention. For example, the printing machine shown and described is exemplary only and a variety of printing machine models and types can be employed. Likewise, the particular bags and cases shown are exemplary only and the techniques applied herein can be applied to other forms of business accessories that include an appropriate substrate. Accordingly, this description is meant only to be taken by way of example and not to otherwise limit the scope of the invention.

What is claimed is:

1. A method for providing a customized decoration to an item comprising:

providing a printing machine, the printing machine including an inking plate having the customized decoration thereon, an inking pad and a printing pad movably disposed above the inking plate, a support structure for removably mounting the item, and a jig fixedly mounted with respect to the support structure for retaining a flexible plastic substrate adhered to the item, the flexible plastic substrate projecting from a surrounding surface of the item;

removably mounting the item in the support structure;

retaining the substrate on the item within the jig, including engaging at least a portion of the perimeter edge of the substrate to secure the substrate with respect to the jig during the printing step;

inking the customized decoration on the inking plate with the inking pad; and printing the customized decoration on the substrate with the printing pad.

2. The method as set forth in claim 1 wherein the step of retaining includes placing an edge of the item having the substrate mounted therealong against a wall of the jig and applying a plate containing an aperture in the shape of the substrate over the item so as to capture a perimeter edge of the substrate within the aperture.

3. The method as set forth in claim 2 wherein the item comprises one of either a portfolio or a padfolio.

4. The method as set forth in claim 1 wherein the substrate is mounted on a side pocket of the item and the step of placing the edge includes directing a plate of the jig between a side of the item and the pocket.

5. The method as set forth in claim 2 wherein the plate containing the aperture is a hinged retaining plate adapted to rotate about a hinge to one of either an engaged position, in which the plate captures the perimeter edge of the substrate within the aperture, or a disengaged position, in which the item is removably mountable in the support structure.

6. The method as set forth in claim 1 wherein the substrate is a soft rubberized plastic with a surface finish adapted to accept ink.

7. The method as set forth in claim 6 wherein the step of printing includes applying ink to a domed face of the substrate with a printing element having a curved edge that flexes as the printing element contacts the domed face.

8. The method as set forth in claim 1 further comprising receiving an order for production of the item with the decoration and producing the plate from an image of the decoration supplied by a customer.

9. A method for providing a customized decoration to an item comprising:

providing a printing machine, the printing machine including an inking plate having the customized decoration thereon, an inking pad and a printing pad movably disposed above the inking plate, a support structure for removably mounting the item, and a jig fixedly mounted with respect to the support structure for retaining a flexible plastic substrate attached to the item by elastic cords;

removably mounting the item in the support structure;

retaining the substrate on the item within the jig by stretching elastic cords attached to the substrate so as to seat the substrate in a well structure on the jig;

inking the customized decoration on the inking plate with the inking pad; and printing the customized decoration on the substrate with the printing pad.

10. The method as set forth in claim 9 wherein the item is one of either a bag or case and the elastic cords are attached to a side of the bag or case.

11. A printing machine for printing customized business accessories comprising:

an inking plate with a formation of a predetermined decoration thereon;

an inking pad for inking the decorative formation, the inking pad being movably disposed above the inking plate;

a support structure for each business accessory, a jig, fixedly mounted with respect to the support structure, that is adapted to retain and align, with respect to a predetermined location, a flexible plastic substrate adhered to and projecting from a surrounding surface of each business accessory; and a printing pad movably disposed above the inking plate that transfers ink in the form of the decoration from the formation to the predetermined location so as to print the decoration on the substrate.

12. The printing machine as set forth in claim 11 wherein the jig includes a well structure adapted to seat the substrate in the well structure.

13. The printing machine as set forth in claim 12 wherein the business accessory is one of either a bag or case and the jig is adapted to retain and align a substrate when the substrate is secured in the support structure.

14. The printing machine as set forth in claim 11 wherein the jig includes a wall for engaging an edge of the business accessory in which the substrate is along the edge and a plate containing an aperture in the shape of the substrate adapted to be placed over the business accessory so as to capture a perimeter edge of the substrate within the aperture.

15. The printing machine as set forth in claim 14 wherein the business accessory comprises one of either a portfolio and the support structure is are adapted to support the one of either the portfolio or the padfolio.

16. The printing machine as set forth in claim 15 wherein the substrate is mounted on a side pocket of the business accessory and the jig further includes a plate adapted to pass between a side of the business accessory and the side pocket.

17. The printing machine as set forth in claim 14 wherein the plate containing the aperture is a hinged retaining plate adapted to rotate about a hinge to one of either an engaged position, in which the plate captures the perimeter edge of the substrate within the aperture, or a disengaged position, in which the item is removably mountable in the support structure.

18. The printing machine as set forth in claim 11 wherein the pad defines a curved edge that flexes as the printing element contacts the substrate so as to conform to a domed surface on the substrate.

19. The printing machine as set forth in claim 11 wherein the formation is an image of the decoration provided by a customer requesting the business accessory.

20. The printing machine as set forth in claim 11 wherein the inking pad and printing pad comprise elements of a single mechanism movably disposed above the inking plate and jig.

21. The printing machine as set forth in claim 20 wherein the mechanism rests in one of either a first position with the inking pad disposed either directly above or in contact with the inking plate and the printing pad disposed either directly above or in contact with the substrate, or a second position with the printing pad disposed either directly above or in contact with the inking plate.

* * * * *